United States Patent [19]

Johnson

[11] 4,407,496

[45] Oct. 4, 1983

[54] LIMB EXERCISE DEVICE

[76] Inventor: David E. Johnson, Apt. 101, 2900 Autumn Dr., Dubuque, Iowa 52001

[21] Appl. No.: 330,141

[22] Filed: Dec. 14, 1981

[51] Int. Cl.[3] ..... A63B 21/06

[52] U.S. Cl. ..... 272/117; 272/DIG. 4; 272/143

[58] Field of Search ..... 272/130, 132, 134, 136, 272/143, 93, 117; 128/25 R

[56] References Cited

U.S. PATENT DOCUMENTS

| | | | |
|---|---|---|---|
| 2,777,439 | 1/1957 | Tuttle | 272/132 X |
| 2,855,199 | 10/1958 | Noland et al. | 272/117 |
| 2,924,214 | 2/1960 | Zak | 128/25 R |
| 3,285,070 | 11/1966 | McDonough | 272/134 X |
| 3,465,592 | 9/1969 | Perrine | 272/130 X |
| 3,976,057 | 8/1976 | Barclay | 272/130 X |

*Primary Examiner*—Richard C. Pinkham
*Assistant Examiner*—William R. Browne
*Attorney, Agent, or Firm*—James C. Nemmers

[57] ABSTRACT

An exercising device for use in strengthening, conditioning and rehabilitating body joints such as the knee and shoulder. The device is used in connection with conventional exercising apparatus to minimize detrimental shearing forces on the joint during the exercise procedures. This is accomplished by replacing the conventional single contact pad on the limb with two contact pads or pad and handgrip mounted on a variable fulcrum that will produce the desired counterforce to the shearing force on the joint.

9 Claims, 5 Drawing Figures

FIG. 1
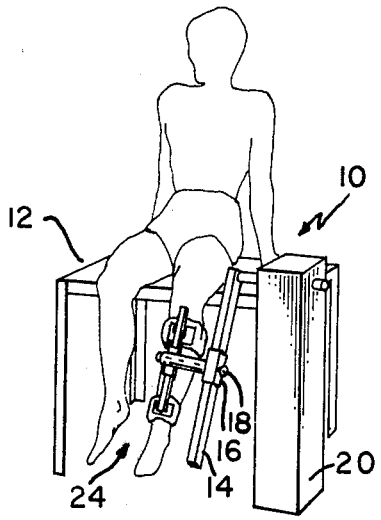
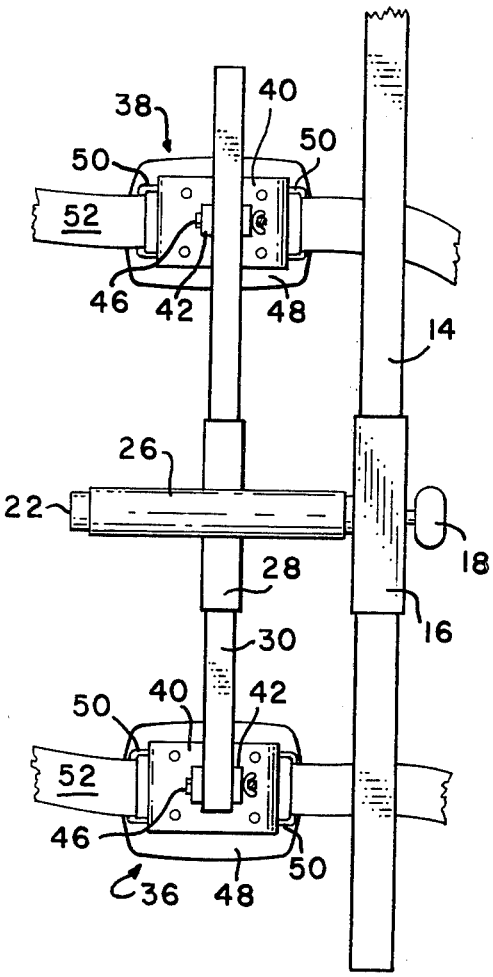
FIG. 2
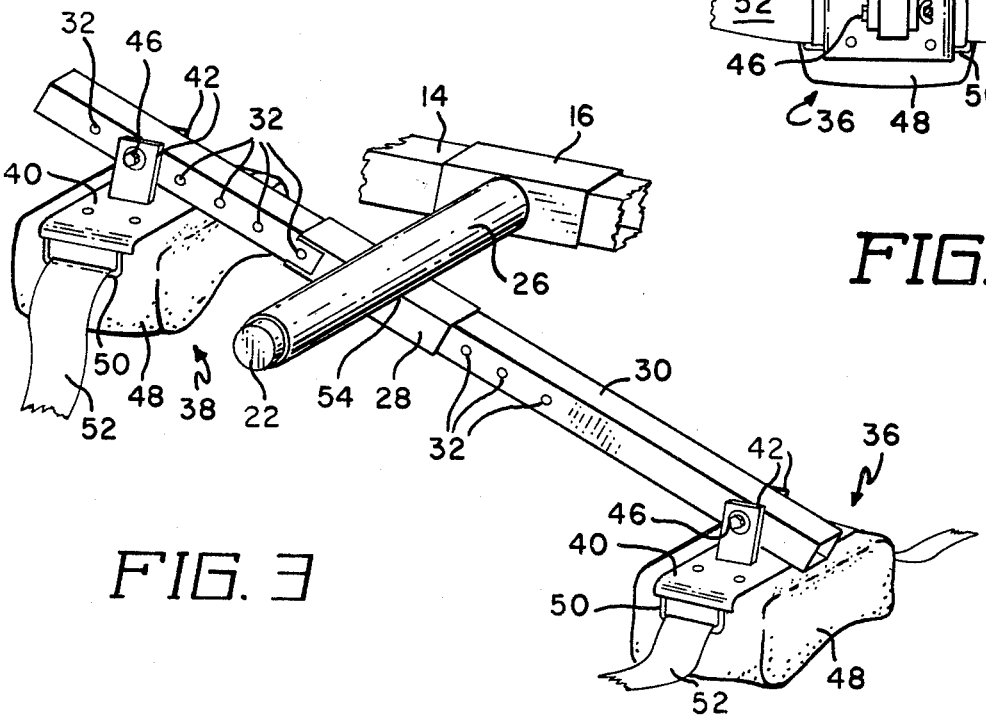
FIG. 3

FIG. 4
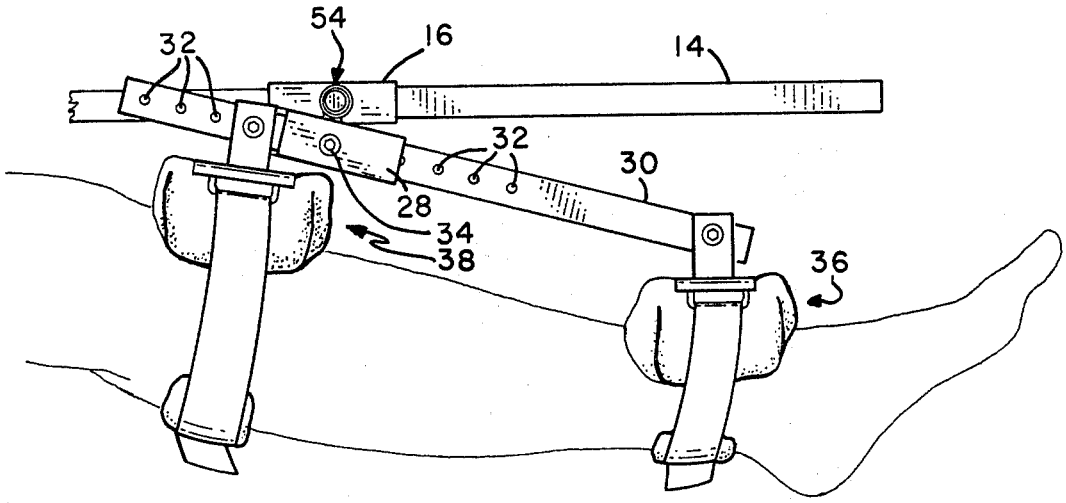
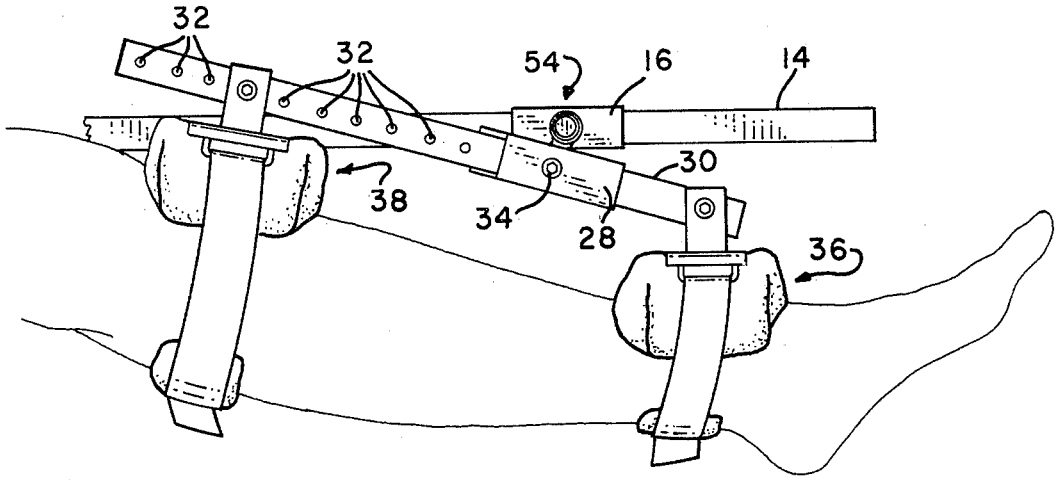
FIG. 5

LIMB EXERCISE DEVICE

BACKGROUND OF THE INVENTION

Public interest in sports of all types has increased dramatically in recent years. Along with the increased interest, compensation to athletes at the professional level has attained heights almost unheard of a decade ago. As a result, competition among athletes for positions on high paying professional teams has brought about levels of performance, strength and endurance that seem to increase year after year. Because of the high level of athletic ability and skill at almost all levels of competition, participants must be in top condition in order to perform at the required levels. As a result, athletes at all levels of amateur and professional sports are participating in conditioning and injury prevention programs using a variety of equipment. Moreover, injuries in sports have increased, and rehabilitation programs have been designed to quickly return the injured athlete to his or her previous level of performance. Especially in contact sports, such as football, injury prevention and rehabilitation programs are now a year-round part of the athlete's routine.

There are available commercially numerous types of equipment to test and exercise every major body joint and muscle group. Such equipment is extremely effective and reasonably safe if properly used. However, such exercises designed to strengthen the muscles supporting the body joints sometimes create undesirable shear forces on the joint being conditioned or rehabilitated with the result that the program is not as effective as it might otherwise be. In some instances, these shearing forces that are exerted on a joint during exercise programs can be detrimental. This is primarily due to the manner in which the exercise equipment is designed. Generally, such equipment requires the person using it to exact force at a particular point on a limb which force is resisted by the equipment. Very often, however, the point of application of the force is at a point distant from a body joint, and during the exercise the contracting muscles apply a shearing effect to the joint.

There is therefore a need for an improved device which can minimize these shearing forces without interfering with or detracting from the desired conditioning or rehabilitating effect on the muscles.

SUMMARY OF THE INVENTION

The invention relates to an exercise device that is used in connection with equipment for conditioning and rehabilitating muscles and joints. Such equipment is extensively used in sports medicine but is also used for orthopedic patients and in industrial medicine and compensation cases. Such equipment is generally secured to the user's leg, for example, and the user then lifts the leg against the force exerted by the equipment in order to strengthen certain leg muscles. The equipment is generally secured to a point on the body, such as the distal shank, that is at a considerable distance from the joint being exercised, such as the knee. When movement of the limb is resisted by the equipment at its distant contact point, the muscles creating the movement also create undesirable and sometimes detrimental shearing force on the joint. The device of the invention substitutes, for the single pad at which the limb is resisted, a dual-pad or pad-handgrip system which is pivotally mounted on an arm that is in turn pivotally mounted to the exercise equipment in such a way that the fulcrum between the two pads or between the pad and handgrip is variable. This arrangement allows a counter-balancing force to be exerted near the joint to offset the undesirable shearing forces at the joint.

The invention therefore provides an improved exercising device that is adaptable to existing equipment and yet is very simple and inexpensive while still producing greatly improved results during conditioning and rehabilitating exercise procedures.

BRIEF DESCRIPTION OF THE DRAWINGS

FIG. 1 is a perspective view of equipment including an exercise device embodying the invention and showing the manner in which it is used for conditioning the knee joint;

FIG. 2 is a top or plan view of the exercise device of the invention;

FIG. 3 is a perspective view of the exercise device of FIG. 2;

FIG. 4 is a side elevational view showing the device in place on a user leg and adjusted to apply a large counterforce to the knee joint; and FIG. 5 is a side elevational view similar to FIG. 4 but showing the device adjusted so as to apply a small counterforce to the knee joint.

DESCRIPTION OF THE PREFERRED EMBODIMENT OF THE INVENTION

The exercise device of the invention is designed for use with any type of commercially available exercise equipment used in rehabilitating and conditioning almost every major body joint/muscle group. An example of a very basic piece of equipment of this type is that shown in U.S. Pat. No. 2,855,199, issued on Oct. 7, 1958, and entitled "Exercise Device". The apparatus shown in this patent provides a device in which resistance can be applied at any point in the range of motion of the muscle group being exercised. This is accomplished by placing the limb, such as the leg, being exercised against a leg rest positioned at the outer end of a lever arm which is operatively connected to a variable resistance device. The user then exercises his leg muscles by repeatedly moving the lever arm against the resistance.

In all known devices and equipment of this type, the limb to be exercised is placed against a single contact point on the equipment. Usually, the contact point with the limb is at a distal point, such as distal shank or hand. Depending upon the muscle group to be conditioned, the ankle is swung upwardly against the resistance of the equipment by extending the knee joint. When this occurs, the shear component of force created by the contracting muscles is left unchecked and is applied to the knee joint, which can be detrimental and in some instances actually cause further injury, particularly where the knee was the injured joint that is being rehabilitated.

In FIG. 1, there is shown the device of my invention affixed to an exercising machine of the general type previously described and which is indicated generally by the reference numeral 10. All of the details of such a machine are not shown since they are well known to those skilled in the art, but basically the machine consists of a table 12 or other body support upon which the user either sits or lies. Secured to the table 12 is a swingable exercise arm 14 to which there is slidably attached a sleeve 16 that can be secured in a selected position by means of the thumb screw 18. The exercise arm 14 is pivotally connected at its inner end to the resistance creating mechanism 20. The details of this mechanism 20 will not be described since such mechanisms are well known to those skilled in the art. However, exercise equipment of this type generally provides a means for varying the force that is required to pivot the exercise arm 14.

Extending laterally from the sleeve 16 is a pivot bar 22. The exercise device of the invention, indicated generally by the reference numeral 24, is pivotally mounted on the pivot bar 22 by means of a tubular sleeve 26. Secured perpendicularly to the tubular sleeve 26 is a square tubular sleeve 28 through which there is slidable a connecting bar 30 having a plurality of positioning openings 32. The tubular sleeve 28 is maintained in a selected position by aligning one of the positioning openings 32 in the connecting bar 30 with a corresponding opening (not shown) in the tubular sleeve 28 and allowing a fastener, such as bolt 34 (FIGS. 4 and 5), to engage in the corresponding openings to lock the two members in a selected relative position.

Pivotally secured to the outer end of the connecting bar 30 is a distal pad 36 while a similar proximal pad 38 is pivotally secured to the inner end of the connecting bar 30. The distal pad 36 and the proximal pad 38 each have a supporting plate 40 to which there are affixed upwardly extending brackets 42 that provide a pivotal connection with the connecting bar 30. The pivotal connection is provided by means of inserting a fastening member such as bolt 46 to one of the positioning openings 32 in the connecting bar 30.

The distal pad 36 and proximal pad 38 also each have a cushioned member 48 secured to the supporting plate 40 which member 48 engages the limb of the user. Supporting plate 40 also has a ring 50 affixed at its opposite ends which rings 50 provide for attachment of an adjustable strap 52 used to secure the device 24 to the limb of the user.

When properly used, the distal pad 36 is pivotally attached to the outer or distal end of the connecting bar 30. Preferably, in its application to exercise of the knee joint, the distal pad 36 always remains in the same position relative to connecting bar 30, but the proximal pad 38 can be positioned by inserting the bolt 46 through the brackets 42 and a corresponding selected one of the positioning openings 32. This allows the excess length of the connecting bar 30 at its inner end to always extend up over the knee and out of the way rather than interfering with the foot if the distal pad 36 were moved proximally. If the device of my invention is used to exercise the shoulder joint, the proximal pad 38 would be used and would always remain in the same position relative to the connecting bar 30. However, the distal pad 36 would be replaced by a distal handgrip (not shown) capable of being grasped by the hand. Preferably, the distal handgrip would be repositioned at any of the plurality of positioning openings 32. This allows the excess length of the connecting bar 30 at its outer end to always extend beyond the hand and out of the way of the user rather than interfering with the shoulder girdle or neck if the proximal pad 38 were moved distally.

In its application to the knee joint, the adjustability feature allows the proximal pad 38 to be properly positioned depending upon the size of the user's limb and the muscle group that is to be conditioned or rehabilitated. As shown in FIGS. 4 and 5, the distal pad 36 is positioned in the typical place at the distal shank. The proximal pad 38 is positioned over the tibial tubercle. In FIG. 3, the fulcrum 54 provided by the pivotal connection between the pads 36 and 38 is located somewhat closer to the proximal pad 38 than the distal pad 36. This arrangement appears to be the most effective for most conditioning and rehabilitating exercise procedures. However, as illustrated in FIG. 5, the physical therapist has the option of moving the fulcrum 54 distally so as to produce a comparatively smaller counterforce to the anterior shear force on the knee joint. Similarly, in FIG. 4, the fulcrum 54 is moved proximally to provide a relatively greater counterforce on that knee joint. The proper position of the fulcrum 54 will depend upon the ultimate result that is to be accomplished. However, in any of the positions shown in FIGS. 3, 4 and 5, the proximal pad 38 will provide the necessary counterforce to minimize the undesirable shearing force on the knee joint. With devices that are presently known and used using a single pad or single handgrip, a relatively high shearing force can be applied to the joint that can in some instances aggravate an already injured joint.

Thus, with the device of the invention, full benefits of muscle/joint conditioning and rehabilitation can be accomplished without the possible adverse effects common to existing exercise equipment. Although my device has been shown as being used in connection with a particular piece of exercise equipment designed primarily for knee exercising, it is easily adaptable to almost any piece of equipment designed and used for rehabilitation and conditioning of joint/muscle groups. There are machines commercially available that are used for shoulder rehabilitation and for rehabilitation of all peripheral joints, but the device of the invention using a proximal pad and a distal resistance pad or handgrip mounted on a variable fulcrum can be applied and used in connection with any of this other equipment. Moreover, although I have described my invention only in connection with a preferred embodiment of it, it will be obvious to those skilled in the art that various revisions and modifications can be made to the preferred embodiment without departing from the spirit and scope of the invention. It is my intention however that all such revisions and modifications as are obvious to those skilled in the art will be included within the scope of the following claims.

I claim:

1. An exercise device for use in connection with a body joint and limb exercising apparatus which has a movable member to which the apparatus applies a force against movement of the member, said exercise device comprising an elongated member having a distal end and a proximal end, first limb engaging means connected to said elongated member at a point near the distal end of said elongated member and engageable with a limb of a user, second limb engaging means connected to said elongated member at one of a plurality of selected points near the proximal end of said elongated member, said second engaging means being attached to the same limb of a user at a point on the limb spaced from the point of engagement of the first limb engaging means, third means associated with said first and second limb engaging means providing for a releasable attachment of the first and second limb engaging means to the same limb of a user, and connection means along said elongated member providing for varying points of attachment of the movable member to said elongated member at a selected point between the points of attachment of said first and second limb engaging means means with the limb of the user.

2. The exercise device of claim 1 in which said connection means includes means providing for varying the point of connection of the elongated member to the movable member of the exercising apparatus.

3. The exercise device of claim 2 in which said connection means includes means providing for pivotal movement of the elongated member about an axis transverse to the elongated member.

4. The exercise device of claim 3 in which the first and second limb engaging means means are pivotally connected to the elongated member.

5. The exercise device of claim 3 in which the first and second limb engaging means means are separate members and are each pivotally connected to said elongated member.

6. The exercise device of claim 5 in which means is provided for varying the point of connection of the second limb engaging means to the elongated member.

7. The exercise device of claim 5 in which means is provided for varying the point of connection of the first limb engaging means to the elongated member.

8. The exercise device of claims 1, 2, 3, 4 or 5 in which the second limb engaging means and the first limb engaging means are each adapted for releasable engagement with the leg of a user.

9. The exercise device of claims 1, 2, 3, or 4 in which the second limb engaging means is adapted for releasable engagement with the arm of a user and the second limb engaging means is adapted for gripping by the hand of a user.

* * * * *